US006913076B1

(12) United States Patent
Hays

(10) Patent No.: US 6,913,076 B1
(45) Date of Patent: Jul. 5, 2005

(54) HIGH TEMPERATURE HEAT PUMP

(75) Inventor: Lance G. Hays, Placentia, CA (US)

(73) Assignee: Energent Corporation, Santa Ana, CA (US)

( * ) Notice: Subject to any disclaimer, the term of this patent is extended or adjusted under 35 U.S.C. 154(b) by 0 days.

(21) Appl. No.: 10/196,263

(22) Filed: Jul. 17, 2002

(51) Int. Cl.[7] ..... F28F 27/00

(52) U.S. Cl. ..... 165/274; 62/197; 62/238.6; 60/651; 60/653; 60/655

(58) Field of Search ..... 165/274, 47, 48.1, 165/58, 61, 62, 64; 62/112, 197, 238.6, 91, 62/402; 60/653, 651, 671, 655

(56) References Cited

U.S. PATENT DOCUMENTS 3,971,211 A * 7/1976 Wethe et al. ..... 60/655
4,152,901 A * 5/1979 Munters ..... 62/112
5,038,583 A * 8/1991 Gali ..... 62/402
5,385,446 A 1/1995 Hays
5,515,694 A * 5/1996 Meloling et al. ..... 62/197
5,778,696 A * 7/1998 Conner ..... 62/238.6
5,819,554 A * 10/1998 Glen ..... 62/116
5,911,745 A * 6/1999 Conner ..... 62/91
6,250,105 B1 * 6/2001 Kimble
6,397,600 B1 * 6/2002 Romanelli ..... 60/651
6,581,384 B1 * 6/2003 Benson ..... 60/653
6,644,062 B1 * 11/2003 Hays

FOREIGN PATENT DOCUMENTS

JP 4-4062340 * 2/1992

* cited by examiner

*Primary Examiner*—Ljiljana Ciric
(74) *Attorney, Agent, or Firm*—William W. Haefliger

(57) ABSTRACT

A high temperature heat pump comprising a low temperature heat exchanger to produce vapor of a first fluid from heat transferred from a second fluid to a mixture of liquid and vapor of the first fluid; a compressor to increase the pressure and temperature of the produced vapor; a high temperature heat exchanger to heat the second fluid to useful, high temperatures from the condensation of the first fluid; and an expander to lower the pressure and temperature of the first fluid producing a mixture of vapor and liquid.

25 Claims, 3 Drawing Sheets

HEAT LOAD
HIGH TEMPERATUR HEAT EXCHANGER
MOTOR
LOW TEMPERATURE HEAT EXCHANGER
TWO-PHASE TURBINE
COM-PRESSOR
FLUID (2)
FLUID (1)
1
2
3
4
5
6
7
8
9
10
11
12
13
14
14a
15
16
16'
16''
17
18
19

HEAT LOAD
HIGH TEMPERATURE HEAT EXCHANGER
MOTOR
COM-PRESSOR
LOW TEMPERATURE HEAT EXCHANGER
1a
2b
3a
4a
5a
6a
7a
8a
9a
10a
11a
12a
13a
14b
16a
17a
18a
19a

HEAT EXCHANGER, 8
15
COMPRESSOR, 14
HEAT EXCHANGER, 3
13
EXPANSION VALVE, 17a
X'
X
18
16
h1
h2
TWO-PHASE TURBINE, 17
g
T
TEMPERATURE
S
ENTROPY

HIGH TEMPERATURE HEAT PUMP

BACKGROUND OF THE INVENTION

This invention relates generally to utilization of waste heat in industrial applications, and in buildings, and more particularly to use of heat pumps to enable such waste heat utilization.

The amount of low level (<200 F) waste heat in commercial buildings and industry is enormous. Many studies have been performed on application of heat pumps to convert this lower level heat to a higher temperature at which it is useful. However, the economics of such systems and their relatively lower temperature capabilities have limited their application.

SUMMARY OF THE INVENTION

It is a major object of the invention to provide method and means to enable waste heat utilization in an efficient and cost effective manner.

A further object is to use a high temperature refrigerant in a heat pump cycle to raise the temperature of waste heat to a high temperature at which the heat is useful.

Yet another object is to provide an unusually effective way to use the output of a heat pump to produce steam.

An added object is to utilize a two-phase turbine to reduce the throttling losses in the heat pump cycle, thereby increasing efficiency.

Another object is to utilize a high temperature heat pump to reduce steam production in the winter time while increasing the electricity sold.

Basically, the invention is embodied in heat pump apparatus comprising a) a low temperature heat exchanger to produce vapor of a first fluid from heat transferred from a second fluid to a mixture of liquid and vapor of the first fluid, b) a compressor to increase the pressure and temperature of the produced vapor, c) a high temperature heat exchanger to heat the second fluid to useful, high temperatures from the condensation of the first fluid, d) an expander to lower the pressure and temperature of the first fluid producing a mixture of vapor and liquid.

As will be seen, the expander may for example comprise a two-phase turbine, and the compressor may derive a fraction of its required power from the turbine. The expander may alternatively comprise a liquid expansion valve.

A further object is to vaporize the second fluid by heat transfer in a high temperature heat exchanger, and additional load means may be provided to receive the second fluid vapor for use, as in:

i) a heating system ii) a building heating system iii) a building heating system also served by a district heating system iv) a building heating system also served by a boiler v) an industrial process employing heat input.

These and other objects and advantages of the invention, as well as the details of an illustrative embodiment, will be more fully understood from the following specification and drawings, in which:

DRAWING DESCRIPTION

DETAILED DESCRIPTION

Figure 1:
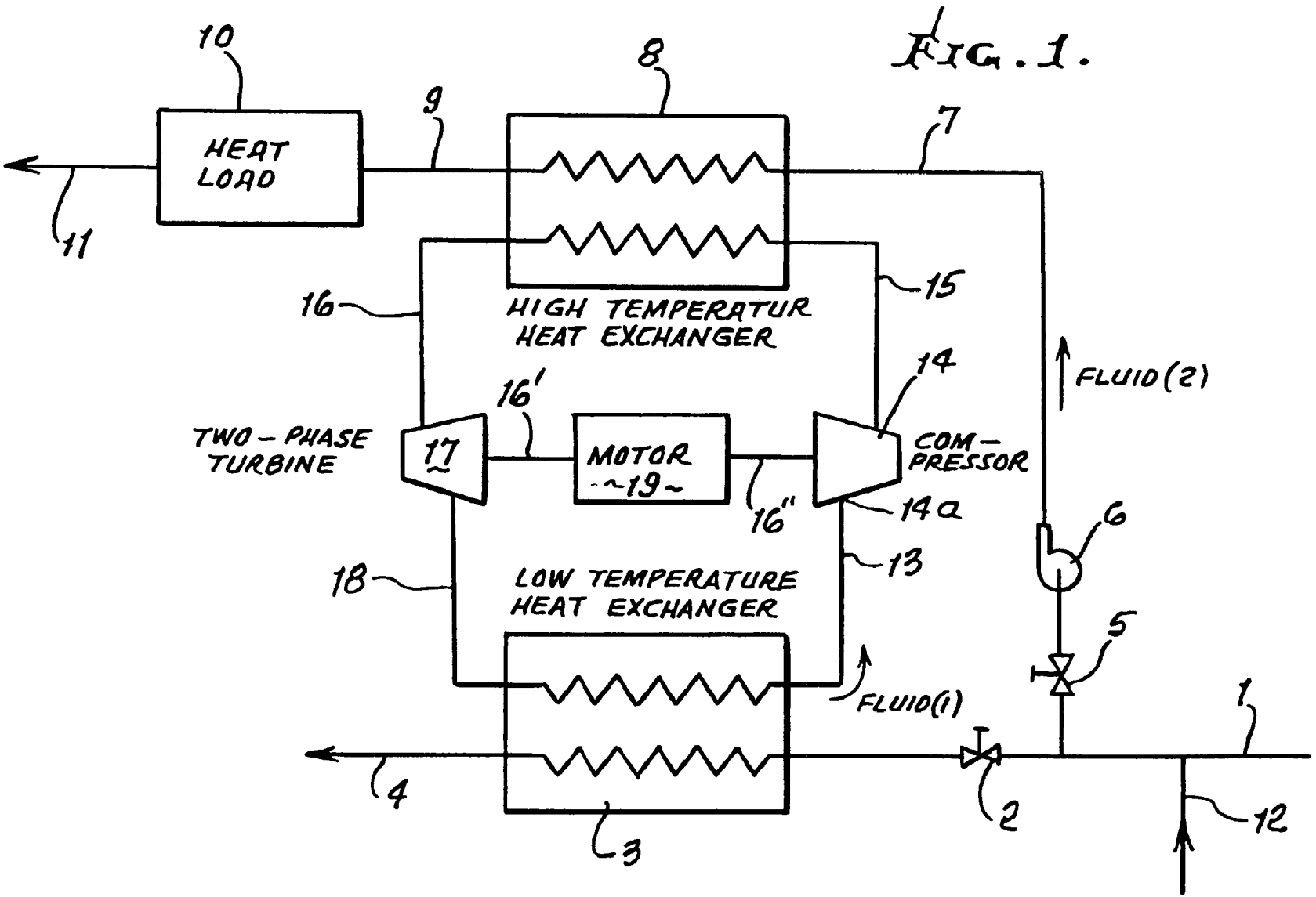
FIG. 1 is a diagrammatic view of a system embodying the invention, and employing a high temperature heat pump, with a two-phase turbine.

FIG. 1 shows a heat pump with a two-phase turbine to recover throttling losses in the cycle. A fluid stream (the "waste flow") 1, having a lower temperature than would normally be useful, flows though a pipe or other duct. It can be mixed with another fluid stream, 12, also having a lower temperature than would normally be useful. Part of the waste flow, regulated by a valve 2, flows through a lower temperature heat exchanger 3, where heat is transferred to vaporize a working fluid 18, at a yet lower temperature. Another part of the waste flow is regulated by a valve 5, pressurized by a pump 6, to the desired high temperature vapor pressure and flows to the high temperature heat exchanger 8.

The temperature of the waste flow 4 leaving the low temperature heat exchanger is lower than the temperature when it entered. The waste flow is discharged for waste disposal or another use.

The working fluid stream 18 is completely vaporized in the low temperature heat exchanger and leaves as a vapor.

The vapor of the working fluid 13 is compressed to a high pressure and temperature by the compressor 14, which is driven by a motor 19 via shaft 16". The resulting high temperature working fluid vapor at 15 enters the high temperature heat exchanger 8, in which it transfers heat to another part 7, of the waste flow 1. The working fluid vapor is condensed in the high temperature heat exchanger, resulting in a liquid stream 16, which is at a higher pressure and temperature than the working fluid vapor entering the compressor at 13.

The working fluid is expanded in a two-phase turbine 17, to low pressure 18, flashing and cooling the working fluid. The temperature at 18 is very nearly the same as at the compressor inlet 14*a*. The power generated by the two-phase turbine can be via shaft 16' used to reduce the net power consumed by the compressor 14. A typical two-phase turbine is of the type described in U.S. Pat. No. 5,385,446, or in references listed therein.

The portion of the waste flow 7, entering the high temperature heat exchanger is vaporized at a high temperature and pressure 9, forming a useful fluid stream which can be used, for example, in a heat exchanger load 10. The cooled useful fluid stream 11, leaving the heat exchanger load can be re-mixed with the waste flow stream, for example at 12, to recycle the fluid and recover additional heat.

Figure 2:
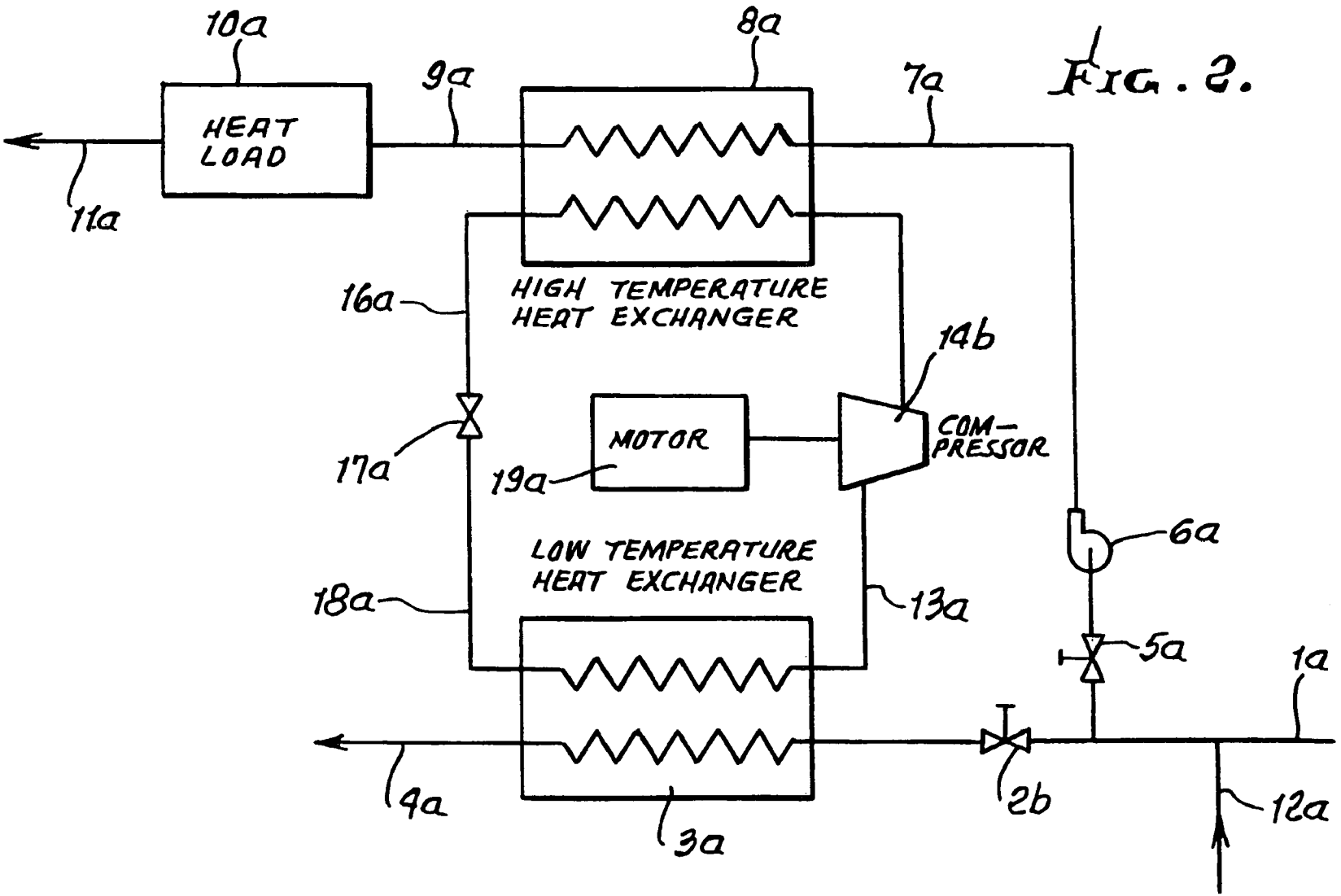
FIG. 2 is a diagrammatic view of a system embodying the invention, and employing a high temperature heat pump, with an expansion valve.

Another variation of the high temperature heat pump, which uses a valve for expansion instead of the two-phase turbine, is shown in FIG. 2. A fluid stream (the "waste flow") 1*a*, having a lower temperature than would normally be useful, flows through a pipe or other duct. It can be mixed with another fluid stream 12*a*, also having a lower temperature than would normally be useful. Part of the waste flow, regulated by a valve 2*b*, flows through a low temperature heat exchanger 3*a*, where heat is transferred to vaporize the working fluid 18*a*, at a yet lower temperature. Another part of the waste flow is regulated by a valve 5*a*, then pressurized by a pump 6*a*, to the desired high temperature vapor pressure, and flows to the high temperature heat exchanger 8*a*.

The temperature of the waste flow 4*a*, leaving the low temperature heat exchanger is lower than the temperature when it entered. The waste flow is discharged for waste disposal or another use.

The working fluid stream 18*a* is completely vaporized in the low temperature heat exchanger and leaves as a vapor.

The vapor of the working fluid at 13*a* is compressed by the compressor 14*b*, to a high pressure and temperature. The high temperature working fluid vapor enters the high temperature heat exchanger 8*a*, in which it transfers heat to another part 7*a* of the waste flow 1*a*. The working fluid vapor is condensed in the high temperature heat exchanger, resulting in a liquid stream 16*a*, which is at a higher pressure and temperature than the working fluid vapor entering the compressor at 13*a*.

The working fluid is expanded in a valve 17*a* to the low pressure of flow at 18*a*, flashing and cooling the working fluid. The temperature of fluid at 18*a* is very nearly the same as the temperature of fluid 13*a* supplied to the compressor inlet.

The portion of the waste flow 7*a*, entering the high temperature heat exchanger 8*a* is vaporized at a high temperature and pressure, at 9*a* forming a useful fluid stream which can be used, for example, in a heat exchanger load 10*a*. The cooled useful fluid stream 11*a* leaving the heat exchanger load can be re-mixed with the waste flow, for example at 12*a*, to reuse the fluid and recover additional heat.

Figure 3:
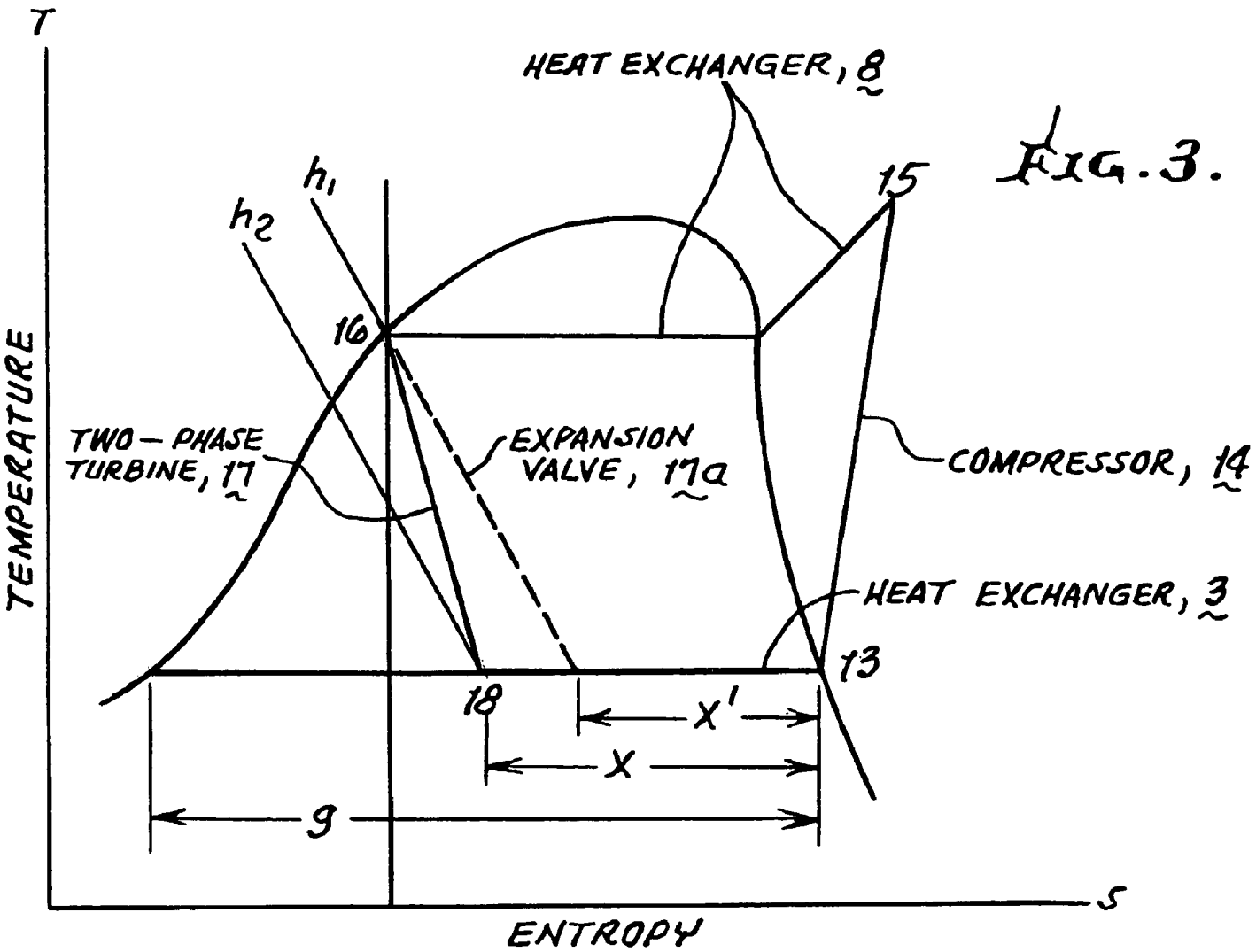
FIG. 3 is a temperature entropy diagram, for the high temperature heat pump, shown in FIGS. 1 and 2.

FIG. 3 illustrates the two high temperature heat pumps on a temperature-entropy diagram for the working fluid. The working fluid vapor enters the compressor 14 at 13. The compressor 14 increases the temperature and pressure to level 15. The working fluid flows through the high temperature heat exchanger 8 leaving as saturated liquid at 16. The working fluid is expanded in the turbine 17 to a lower temperature and pressure, at 18. The power generated is proportional to the enthalpy difference $h_1-h_2$.

The liquid fraction of the working fluid x/y, is vaporized in the low temperature heat exchanger by the heat from the first fluid stream to provide the vapor working fluid stream 13 to the compressor. If an expansion valve 17*a* is used instead of the two-phase turbine, no power is generated. In addition a lower liquid fraction x'/y is generated.

An analysis was performed using the heat pump to convert heat from a stream of low temperature water to produce high temperature steam.

For purposes of the discussion, consider the conditions analyzed as an example. Heat exchanger pressure drop is neglected for the example.

Refrigerant vapor is generated in the low temperature heat exchanger by heat from a low temperature water stream or other fluid stream. For the case analyzed the waste flow stream is at 160° F. The refrigerant vapor at 13 is saturated. For the case analyzed the refrigerant is R 123. It is assumed to be vaporized at 150°, at which temperature the saturation pressure is 48.6 psia.

The saturated vapor enters a compressor where, as in a conventional refrigeration cycle, the vapor is compressed to a higher pressure and temperature. For a compressor efficiency of 80% the vapor at 15 leaves the compressor at 260° F. and 199 psia.

The vapor is condensed in the high temperature heat exchanger, transferring heat to a part of the low temperature water stream 7, which has been pressurized to 15 psig by the pump 6 shown. The water is vaporized by the condensing refrigerant, leaving the heat exchanger as steam at 15 psig and 250° F. The steam flow rate is a fraction of the flow rate of the low temperature stream.

The condensed refrigerant leaves the heat exchanger at 16. For the example, the temperature is 250° F. and the fluid is saturated liquid at 199 psia.

The temperature of the condensed refrigerant can be lowered by flashing it to 48.6 psia, either through a valve or through a two-phase turbine. A mixture of vapor and liquid is formed as a result of the expansion. For the conditions chosen, the vapor fraction is 43% with a turbine expansion as in FIG. 1 and 45% with a valve expansion as in FIG. 2.

For the turbine expansion, the power generated is used to decrease the power input required to operate the compressor.

The two-phase refrigerant enters the low temperature heat exchanger wherein the liquid fraction is evaporated, closing the cycle.

Analysis

The property tables for R 123 were used to determine enthalpy and entropy at the cycle state points. Compressor isentropic efficiency and two-phase turbine efficiency were inputs.

For a selected evaporator pressure $p_{13}$, and condenser pressure $p_{15}$, the enthalpy at the compressor discharge is:

$$h_{15}=(h_{i15}-h_{13})/\eta c+h_{13}$$

where:

h=enthalpy at the subscripted cycle point i=isentropic compression value (subscript)

$\eta_c$=compressor isentropic efficiency.

The heat transfer in the high temperature heat exchanger is:

$$Q_h=h_{15}-h_{115}$$

where:

$h_{115}$=enthalpy of saturated liquid at at $P_{15}$, and point 16

$p_{15}$=pressure at compressor exit.

The enthalpy leaving the two-phase turbine is:

$$h_{18}=(h_{115}-h_{i18})(1-\eta_t)+h_{i18}$$

where:

$h_{i18}$=enthalpy for isentropic expansion from point 16 to point 18

$\eta_t$=two-phase turbine isentropic efficiency.

For expansion through the valve:

$$h_{18}=h_{115}$$

The heat transferred to the working fluid to evaporate the liquid fraction is:

$$Q_1=h_{13}-h_{18}.$$

The compressor power is:

$$P_c=h_{15}-h_{13}.$$

The turbine power is:

$$P_t=h_{115}-h_{18}.$$

The net compressor power with a two-phase turbine is:

$$P_n=P_c-P_t.$$

EXAMPLE

The power and heating performance were determined for a waste flow stream temperature of 160° F.; a steam generation temperature of 250° F. at 15 psig; an evaporator temperature of 150° F.; and a compressor outlet pressure of 199 psia (which gives a temperature of 260° F.). The compressor pressure ratio 4.09 is within the range of commercial centrifugal chillers. The compressor efficiency was assumed to be 80% and the two-phase turbine efficiency to be 70%.

With these assumptions the coefficient of performance for the valve expansion was calculated to be:

$$COP_v=Q_h/P_c=13,406 \text{ Btu/kWh}.$$

The coefficient of performance for the turbine expansion was calculated to be:

$$COP_t=Q_h/P_n=15,977 \text{ Btu/kWh}.$$

For these conditions the heat pump using the turbine for power recovery generates 19% more high temperature heat (steam) than the heat pump using an expansion valve.

Economics

The economics were examined for winter conditions in New York. The average steam price is about $20/1000 lb. and the power price is about $0.15/kWh. A 100 kW power input produces 1522 lb/h of 15 psig steam for the heat pump with a two-phase turbine and 1277 lb/h for the heat pump with an expansion valve.

Operation for 4 months at 24/7 duty produces a savings (steam cost minus electricity cost) of $45,000 with the turbine and $31,000 with the expansion valve. For reference the selling price for a commercial 200 ton centrifugal chiller with turbine is believed to be approximately $60,000. If the selling price is doubled for installation costs a simple payback of 2.7 years results for the heat pump with two-phase turbine versus 3.9 years for the unit with an expansion valve.

I claim:

1. A high temperature heat pump comprising:

a) a low temperature heat exchanging means for producing vapor from a first fluid using heat transferred from a second fluid to a mixture of liquid and vapor of the first fluid, b) a compressing means for receiving the produced vapor to increase the pressure and temperature of the produced vapor, c) a high temperature heat exchanging means for receiving the second fluid to heat the second fluid, d) an expansion means for lowering the pressure and temperature of the first fluid to produce a mixture of vapor and liquid of the first fluid, e) wherein the second fluid is vaporized in the high temperature heat exchanger, there being additional load defining means for receiving said second fluid vapor.

2. The high temperature heat pump of claim 1 where the expansion means is a two-phase turbine generating useful power from the expansion.

3. The high temperature heat pump of claim 1 where the expansion means is an expansion valve.

4. The high temperature heat pump of claim 2 where the two-phase turbine is mechanically attached to a motor or a compressor shaft of the compressing means to reduce the required compressing power.

5. The high temperature heat pump of claim 1 where the first fluid is refrigerant R245a.

6. The high temperature heat pump of claim 1 where the second fluid is water.

7. The high temperature heat pump of claim 1 where the second fluid is recycled.

8. The high temperature heat pump of claim 1 wherein said first fluid consists essentially of refrigerant R245a.

9. The high temperature heat pump of claim 1 wherein said second fluid consists essentially of water.

10. The high temperature heat pump of claim 8 wherein said second fluid consists essentially of water.

11. The high temperature heat pump of claim 1 including recycling means for recycling said second fluid from the output side of said high temperature heat exchanger to the input side of said high temperature heat exchanger.

12. The method of operating heat pump apparatus which comprises:

a) providing and operating first means including a low temperature heat exchanger receiving first and second fluids for producing a vapor of the first fluid by heat transfer from the second fluid to a mixture of fluid and vapor of the first fluid, b) providing and operating second means including a compressor connected with the first means to receive said first fluid vapor for compressing said vapor, thereby increasing the pressure and temperature of said first fluid, c) providing and operating third means including a high temperature heat exchanger for receiving the second fluid and said first fluid compressed vapor for heating the received second fluid by heat from condensation of the first fluid vapor, d) providing and operating fourth means including an expansion means for receiving the first fluid vapor condensate and for lowering the pressure and temperature of said first fluid and producing said mixture of liquid and vapor of the first fluid, e) wherein the second fluid is vaporized in the high temperature heat exchanger, there being additional load defining means for receiving said second fluid vapor.

13. The method of claim 12 wherein said expansion means comprises a power generating two-phase turbine.

14. The method of claim 13 wherein said turbine drives an electric generator.

15. The method of claim 12 wherein said second fluid consists essentially of water.

16. The method of claim 12 wherein said second fluid comprises water, and said second fluid vapor comprises steam.

17. High temperature heat pump apparatus comprising, in combination:

a) first means including a low temperature heat exchanger for receiving first and second fluids for producing vapor of the first fluid by heat transfer from the second fluid, said first fluid as received by that heat exchanger being a waste fluid, b) second means including a compressor connected with the first means for receiving said first fluid vapor for compressing said vapor, thereby increasing the pressure and temperature of the first fluid, c) third means including a high temperature heat exchanger for receiving the second fluid and said first fluid compressed vapor for heating the received second fluid by heat transfer from condensation of the first fluid vapor, and d) fourth means including an expansion means for receiving the first fluid vapor condensate and for lowering the pressure and temperature of said first fluid and producing said mixture of liquid and vapor of the first fluid, e) wherein the second fluid is vaporized by heat transfer in the high temperature heat exchanger, there being additional load defining means for receiving said second fluid vapor.

18. The combination of claim 17 wherein said expansion means comprises a power generating two-phase turbine.

19. The combination of claim 18 including an electrical generator driven by said turbine.

20. The combination of claim 18 wherein said expansion means comprises a liquid expansion valve.

21. The combination of claim 18 wherein said compressor is driven by power produced by the turbine.

22. The combination of claim 19 including a motor receiving power from said generator and operatively coupled to said compressor.

23. A high temperature heat pump comprising:

a) a low temperature heat exchanging means for producing vapor from a first fluid using heat transferred from a second fluid to a mixture of liquid and vapor of the first fluid, b) a compressing means for receiving the produced vapor to increase the pressure and temperature of the produced vapor, c) a high temperature heat exchanging means receiving the second fluid to heat the second fluid to, d) an expansion means for lowering the pressure and temperature of the first fluid produce a mixture of vapor and liquid, e) wherein the second fluid is vaporized in the high temperature heat exchanger, there being additional load defining means for receiving said second fluid vapor, f) said compressing means and expansion means being rotary devices rotatively coupled together, and including a motor rotatively coupled to at least one of said devices.

24. The high temperature heat pump of claim 23 wherein said second fluid comprises water, and said second fluid vapor comprises steam.

25. The high temperature heat pump of claim 24 wherein said additional means comprises a system selected from the group consisting of:

vi) a heating system vii) a building heating system viii) a building heating system also served by a district heating system ix) a building heating system also served by a boiler x) an industrial process employing heat input.

* * * * *